US006751894B2

(12) United States Patent
Verseef

(10) Patent No.: US 6,751,894 B2
(45) Date of Patent: Jun. 22, 2004

(54) SNOW REMOVAL APPARATUS AND METHOD OF REMOVING SNOW

(75) Inventor: Jan Verseef, Heiloo (NL)

(73) Assignee: Schmidt Engineering and Equipment, Inc., New Berlin, WI (US)

( * ) Notice: Subject to any disclaimer, the term of this patent is extended or adjusted under 35 U.S.C. 154(b) by 0 days.

(21) Appl. No.: 10/158,404

(22) Filed: May 30, 2002

(65) Prior Publication Data

US 2003/0221338 A1 Dec. 4, 2003

(51) Int. Cl.[7] ..... E01H 5/04; E01H 5/06

(52) U.S. Cl. ..... 37/266; 37/232; 37/281; 172/265

(58) Field of Search ..... 37/232, 266, 281, 37/283, 2, 219, 263, 272, 273, 274, 229; 172/816, 265, 269; 404/104, 101

(56) References Cited

U.S. PATENT DOCUMENTS

| | | | | | |
|---|---|---|---|---|---|
| ,446,326 | A | | 2/1891 | Chambers | |
| ,509,303 | A | | 11/1893 | Fisher | |
| ,977,724 | A | | 12/1910 | Friedman | |
| 1,147,122 | A | | 7/1915 | Scheiden | |
| 1,202,062 | A | | 10/1916 | Hedley et al. | |
| 1,396,846 | A | * | 11/1921 | Jezova | 37/217 |
| 1,462,901 | A | | 7/1923 | Brecht | |
| 1,534,611 | A | | 4/1925 | Schmidt | |
| 1,645,837 | A | * | 10/1927 | Wadsworth | 37/232 |
| 2,055,840 | A | | 9/1936 | Girard | |
| 2,095,096 | A | * | 10/1937 | Humphrey | 37/232 |
| 2,355,160 | A | | 8/1944 | Hodsdon | |
| 2,768,454 | A | | 10/1956 | Schmeche | |
| 2,825,985 | A | * | 3/1958 | Weeks | 172/260.5 |
| 2,847,770 | A | | 8/1958 | Wright | |
| 2,870,469 | A | | 1/1959 | Meece | |
| 3,028,692 | A | * | 4/1962 | Brock | 37/233 |
| 3,091,999 | A | * | 6/1963 | MacDonald | 404/101 |
| 3,156,937 | A | | 11/1964 | Weir | |
| 3,231,991 | A | * | 2/1966 | Wandscheer et al. | 37/280 |
| 3,279,104 | A | * | 10/1966 | Wandscheer et al. | 37/280 |
| 3,598,186 | A | * | 8/1971 | Coontz | 172/445.2 |
| 3,659,363 | A | * | 5/1972 | Snyder | 37/231 |
| 3,680,451 | A | * | 8/1972 | Birtchet | 404/104 |
| 3,762,077 | A | | 10/1973 | Henry et al. | |
| 3,772,803 | A | | 11/1973 | Cote | |
| 4,077,139 | A | * | 3/1978 | Fagervold et al. | 37/280 |
| 4,079,791 | A | * | 3/1978 | Yoder et al. | 172/815 |
| 4,249,323 | A | | 2/1981 | Mathies et al. | |
| 4,356,645 | A | | 11/1982 | Hine et al. | |
| 4,357,766 | A | * | 11/1982 | Croteau et al. | 37/281 |
| 4,552,226 | A | * | 11/1985 | Platter | 172/815 |

(List continued on next page.)

FOREIGN PATENT DOCUMENTS

| | | |
|---|---|---|
| DE | 2519112 | 11/1976 |
| DE | 1190805 | 10/1977 |
| DE | 2617235 | 10/1977 |
| DE | 3928914 | 3/1991 |
| WO | WO 89/01546 | 2/1989 |

*Primary Examiner*—Thomas S. Will
*Assistant Examiner*—Thomas A Beach
(74) *Attorney, Agent, or Firm*—Michael Best & Friedrich LLP

(57) ABSTRACT

An apparatus and a method for removing snow from a travel surface, including a wear member movably connected to a main blade or wing blade. In some embodiments, a fastener connected to the wear member extends through an aperture in the blade and is biased in a downward direction by a biasing mechanism connected to the blade. The biasing mechanism can include a spring, brackets retaining the spring in position with respect to the blade, and a shaft connected to the fastener and to the spring to exert a biasing force (e.g., a downward force) upon the fastener and therefore upon the wear member. The wear member can pivot about a pivot point while the biasing member biases the wear member against the travel surface.

12 Claims, 5 Drawing Sheets

U.S. PATENT DOCUMENTS 4,568,028 A 2/1986 Verseef et al.
4,669,205 A * 6/1987 Smathers ..... 37/232
4,685,228 A 8/1987 Gisler et al.
4,727,665 A 3/1988 Verseef
4,741,116 A * 5/1988 Engle et al. ..... 37/280
4,760,657 A 8/1988 Ganzmann et al.
4,827,637 A 5/1989 Kahlbacher
4,837,951 A 6/1989 Verseef
5,025,577 A 6/1991 Verseef
5,048,207 A 9/1991 Verseef
5,191,729 A 3/1993 Verseef
5,344,254 A * 9/1994 Sartain ..... 404/104
5,638,618 A 6/1997 Niemela et al.
5,655,318 A 8/1997 Daniels
5,697,172 A * 12/1997 Verseef ..... 37/232
5,743,032 A * 4/1998 Vauhkonen ..... 37/446
5,797,203 A 8/1998 Vanerlinden
5,819,444 A * 10/1998 Desmarais ..... 37/281
5,829,174 A 11/1998 Hadler et al.
5,894,689 A 4/1999 Turk
5,899,007 A 5/1999 Niemela et al.
6,019,544 A * 2/2000 Emerson et al. ..... 404/104
6,044,579 A 4/2000 Hadler et al.
6,085,445 A 7/2000 Kanzler
6,154,986 A 12/2000 Hadler et al.
6,523,620 B1 * 2/2003 Burson ..... 172/815

* cited by examiner

SNOW REMOVAL APPARATUS AND METHOD OF REMOVING SNOW

FIELD OF THE INVENTION

The present invention relates generally to apparatuses and methods for moving snow, and more particularly to apparatuses and methods for removing snow from travel surfaces.

BACKGROUND OF THE INVENTION

In the snow removal industry, snow is ordinarily removed from travel surfaces such as roads, runways, driveways, bridges, parking lots, and the like for purposes of safety and improved user travel. Generally, snow is removed with a snowplow, a shovel, a blower, an auger, a broom, or a combination thereof. Despite numerous developments in snow removal technology, several problems still exist with conventional snow removal apparatuses and methods.

There is also a need for a snow removal apparatus which can remove snow from a travel surface with varying cross-sectional elevations. For example, travel surfaces such as roads and runways are often sloped or provided with a crown having a high central elevation and lower outer edges. Generally, the wider the travel surface, the larger the difference between such elevations. Alternatively, travel surfaces can slope inwardly from high outer edges to a central depressed gutter. This type of travel surface shape can serve a number of different purposes, such as to facilitate drainage down the center of the travel surface or to prevent pooling of melted snow, rainwater, runoff, waste, and the like.

Conventional snow removal apparatuses generally remove snow relatively well from areas of the travel surface having the highest elevations. However, conventional snow removal apparatuses generally leave snow on areas of the travel surface having the lowest elevations. In applications in which it is particularly necessary to remove snow from crowned or centrally-depressed travel surfaces (e.g., freeways, highways, airport runways, and taxiways), conventional snow removal apparatuses must often make several passes to remove all or nearly all snow from the travel surface. Alternatively, multiple vehicles are needed to clear snow from the travel surface. Often, even after multiple passes have been made with conventional snow removal apparatuses, snow still remains in areas having the lowest elevations. Therefore, a need exists for a snow removal apparatus capable of removing snow from a travel surface having a varying cross-sectional elevation without necessitating numerous passes and without missing significant quantities of snow.

The cross-sectional shape of a travel surface typically changes along the travel direction (or otherwise along the travel direction of a vehicle clearing snow from the travel surface). For example, a travel surface can have a crown for a distance followed by a relatively horizontal surface without a crown, and/or by a section having a depressed region. Similarly, the travel surface can have bumps, cracks, rumble strips, steps, or other discontinuities which can significantly alter the contours of the travel surface. Additionally, travel surfaces having similar profile shapes often vary in one or more manners (e.g., crown height, slope angle from center, etc.). It is therefore desirable for a snow removal apparatus to be able to adjust to changes in cross sectional elevation of the travel surface. It is also desirable that such adjustment can be made with minimal or no operator input. Because snow removal often takes place in severe operating conditions, automatically adjustable snow removal apparatuses (adjustable from inside or outside of the vehicle) are also preferable.

As discussed above, an important consideration for the design of a snow removal apparatus is the need to remove all or nearly all of the snow from a travel surface. Some travel surfaces (e.g., airport runways and freeways) cannot be used or are dangerous to use unless snow is entirely or nearly entirely removed from the travel surface prior to use. In these applications it may not be sufficient to remove most of the snow from a travel surface, leaving patches of missed snow. These areas of missed snow can be highly dangerous and/or unacceptable and can cause slippery spots on the travel surface. Therefore, airports, freeways, and other similar facilities can be subject to shut-down until snow is entirely or nearly entirely removed from the travel surface. In these cases, delays in removing snow from the travel surface can cost the owners, operators, users, and customers of the travel surfaces significant amounts of lost time and/or money. It is therefore highly desirable to have a snow removal apparatus capable of removing all or nearly all snow from a travel surface or from a given area of a travel surface.

The speed with which a snow removal apparatus removes snow from a travel surface is also an important consideration. Removal of snow is generally a relatively labor intensive operation, and can therefore be fairly expensive and can require skilled operators for satisfactory results.

The ability to store and transport snow removal apparatuses is another important consideration in the design of snow removal apparatuses. Conventionally, snow removal apparatuses are found in increasingly large sizes so that they can remove relatively large amounts of snow in a single pass or in a minimal number of passes. Unfortunately, these relatively large snow removal apparatuses can often be difficult to transport and store. In particular, snowplows are often so wide that it is difficult to store them in garages or other locations. Similarly, these plows can be so large that they present unique issues in transporting such plows on roads and highways. It is therefore desirable for larger snow removal apparatuses to be foldable, collapsible, or to otherwise take a more compact form for storage and transportation.

Another important consideration in the design of snow removal apparatuses is the need to be able to quickly and easily remove the snow removal apparatus from a vehicle and to quickly and easily remount the snow removal apparatus on the vehicle. In the snow removal industry, it is often necessary to remove snow removal apparatuses from vehicles when snowfall is unlikely or when the vehicle is needed for other purposes. Also, when a vehicle is not removing snow, it can be desirable to remove the snow removal apparatus from the vehicle to better preserve the snow removal apparatus and to reduce the weight of the vehicle. The need to remove or remount a snow removal apparatus on a vehicle can occur relatively frequently, particularly when the vehicle is used for snow removal and for other operations such as waste hauling, transportation of material, and the like. For example, snowplows are often coupled to garbage trucks, dump trucks, and other vehicles used for multiple purposes.

Durability is another important design consideration for snow removal apparatuses. Snow removal apparatuses which, push, pull, or throw snow can experience significant and potentially damaging forces. Also, travel surfaces are often paved or covered with gravel, sand, asphalt, concrete, or other similarly abrasive materials. Frequent exposure to these surfaces is likely to damage or to wear away at snow removal apparatuses. Similarly, potholes, rumble strips, speed bumps, and other surface discontinuities can be located on or in a travel surface. Often these discontinuities are hidden under snow or in darkness and are not visible to an operator of the snow removal apparatus. The resulting contact of such elements and features with the snow removal apparatus can damage the snow removal apparatus in some cases. Also, travel surfaces are often covered with corrosive substances such as salt, antifreeze, de-icing solutions, gasoline, oil, and the like. In combination with water, slush, and snow, these substances can cause rust and other corrosion of the snow removal apparatus.

In addition to the above design considerations, snow removal apparatuses that are easy to manufacture, easy to assemble, and inexpensive are highly desirable for obvious reasons. In light of the problems and limitations discussed above, a need exists for a snow removal apparatus which provides good clearing capabilities while being responsive to travel surface changes, discontinuities, and other features, is durable and can withstand harsh operating conditions, can be stored, mounted, and transported relatively easily, and is adjustable to remove all or nearly all snow from a travel surface having a varying cross-sectional elevation. A need also exists for a method by which snow can be quickly and reliably removed from a travel surface and by which a vehicle can be quickly and easily adapted to perform this function. Each preferred embodiment of the present invention achieves one or more of these results.

SUMMARY OF THE INVENTION

The present invention employs a number of features addressing problems of many conventional snow removal apparatuses. Some embodiments of the present invention include a main blade, a right wing blade coupled to the right side of the main blade, and a left wing blade coupled to the left side of the main blade. However, in different embodiments, the present invention can include a single wing blade located on either side of the main blade, two or more wing blades rigidly or moveably coupled together without a main blade, or a main blade without wing blades. In embodiments of the present invention having right and left wing blades, the right and left wing blades can be substantially similar in size and shape or can have significantly different sizes and shapes.

The snow removal apparatus of the present invention can have a number of different configurations and orientations commonly used in conventional snowplows, earth moving equipment, farm machinery, and the like. For example, the snow removal apparatus can have any one or more of the following features: a V-shape viewed from above or below the blade, a curled top or upper portion, a relatively flat front side, a bucket or scoop shaped cross-section, an orientation and arrangement in which snow is directed to one side or both sides of a vehicle or to a relatively central point with respect to the vehicle's path, and a main blade and wing configuration that can be substantially straight and/or can assume other configurations as desired.

In those embodiments having a main blade, the main blade preferably has a front side and a back side. The front side of the main blade is preferably adapted to contact snow and to convey the snow away from a travel surface. Preferably, the back side of the main blade is adapted to be coupled to a vehicle and includes mounting elements, a drive frame, and hardware for this purpose. In this manner, the vehicle can move the snow removal apparatus to a work site, move the snow removal apparatus across a travel surface, and push, pull, or throw snow off of a travel surface by contacting the snow with the main blade.

As mentioned above, some embodiments of the snow removal apparatus have a main blade and a right wing blade and/or a left wing blade. The wing blade(s) are preferably rotatably coupled to the main blade. Most preferably, each wing blade is coupled to the main blade with one or more hinges so that the wing blade(s) can rotate with respect to the main blade about respective axes. In this manner, each wing blade preferably can preferably be folded inwardly and outwardly with respect to the main blade. In this way, the snow removal apparatus can be at least partially collapsed, preferably making transportation and/or storage of the snow removal apparatus less difficult and requiring a smaller storage area. In a similar manner, wing blade(s) can be coupled to the side(s) of the vehicle rather than or in addition to being coupled to a main blade. Preferably, wing blades can be rotated toward the vehicle and/or toward the main blade depending at least in part upon the location and manner of connection of the wing blades. Also, the wing blade preferably has an upper portion and a lower portion located relatively near the travel surface during operation of the snow removal apparatus.

In some preferred embodiments of the present invention, each wing blade includes at least one elongated aperture, a wear member, a pivot about which the wing blade can rotate, at least one biasing mechanism, and at least one fastener extending through each elongated aperture and holding the wear member and the wing blade together. Preferably, a plurality of elongated apertures are spaced along the wing blades and a plurality of fasteners extend through the elongated apertures, holding the wear members and the wing blades together. A biasing mechanism can be connected to each fastener or to fewer than all of the fasteners, if desired.

The location of each of the elongated apertures is preferably determined at least in part by the particular application of the snow removal apparatus. Preferably, at least one elongated aperture is located near the lower portion of the wing blade and extends through a front side of the wing blade. In some preferred embodiments of the present invention, the elongated aperture is located near the outer edge of the wing blade, although other locations along the wing blade are possible. Alternatively, in embodiments having a plurality of elongated apertures, the apertures are preferably spaced relatively evenly along the lower portion of the wing blade.

The elongated aperture(s) preferably extend vertically or substantially vertically on the wing blade. In different embodiments, the elongated aperture(s) can also be arcuately shaped or can be angled so that the elongated aperture (s) extend at an angle relative to a vertical plane.

Preferably, the wear member is located adjacent the wing blade and is coupled to the wing blade by the pivot. In particular, the wear member is preferably coupled to the lower portion of the wing blade so that only the wear member contacts the travel surface to remove snow therefrom during operation of the snow removal apparatus. The wear member can be any length, but is preferably similar in length to the wing blade.

The pivot can take a number of different forms, and in some embodiments is a post extending from the wing blade or an element attached to the wing blade. In other embodiments, the pivot is a conventional fastener which rotatably couples the wear member to the wing blade. Also, in some applications of the present invention, the pivot includes additional elements such as one or more bearings or sleeves to reduce friction between the blade and the wear member and/or to prevent the pivot from becoming damaged or worn from rotation of the wear member about the pivot.

In some preferred embodiments of the present invention, the pivot rotatably couples one end of the wear member to an inner side of the wing blade. In other embodiments, the pivot is located further from the inner edge of the wing blade, and can even be located on the outer edge of the wing blade.

Preferably, each elongated aperture receives a corresponding one of the fasteners. For purposes of simplicity, only one such fastener and elongated aperture will now be referred to. The fastener of the wing blade assembly preferably cooperates with the pivot to enable movement of the wear member with respect to the wing blade. In this regard, the fastener is preferably rigidly connected to the wear member and extends through the elongated aperture in the wing blade. By this connection, the fastener can travel within the elongated aperture, holding the wing blade and the wear member together while allowing the wear member to rotate about the pivot.

Preferably, the fastener is rigidly connected to the wear member and extends through the elongated aperture in the wing blade. A washer and a nut can be connected to the fastener to more securely hold the wear member and the wing blade together. The washer and nut preferably hold the fastener in the elongated aperture and allow the fastener to slide within the elongated aperture while preventing the wear member and the wing blade from separating.

The wing blade can have any number of elongated apertures adapted to receive any number of fasteners as described above. Preferably however, a number of elongated apertures are spaced along the lower portion of the wing blade and receive a plurality of fasteners to securely fasten the wear member and the wing blade together at a number of different locations.

In some preferred embodiments, the biasing mechanism includes a spring, a shaft extending through the spring, a first bracket, and a second bracket. Preferably, the first and second brackets are connected to the wing blade and to the wear member, respectively, and extend away from a rear side of the wing blade. The second bracket is preferably an L-shaped member with first and second legs. The shaft is preferably rigidly coupled to the first leg of the second bracket and extends through an opening in the first bracket. The spring is preferably retained between the first bracket and a shoulder on the shaft. The first leg of the second bracket is preferably coupled to the above-described fastener (connecting the wing blade to the wear member). Alternatively, the first leg of the second bracket can be coupled to the wear member in other manners.

In operation, the wear member preferably follows the contours and the changing cross-sectional elevations of the travel surface by rotating about the pivot as the wear member is moved along the travel surface. Preferably, the wear member can rotate about the pivot while the fastener slides along the elongated aperture to follow changes in elevation of the travel surface. The biasing mechanism preferably provides a downward force to the wear member to hold the wear member in contact with the travel surface while allowing the wear member to rotate about the pivot and to move upward to adapt to a change in elevation of the travel surface. When the contours of the travel surface change, the downward forces of the biasing mechanism preferably maintains the wear member in engagement with the travel surface. In this manner, the snow removal apparatus can preferably remove all or nearly all of the snow from a given travel surface and can overcome or traverse bumps, rumble strips, potholes, and other similar travel surface discontinuities.

Some preferred embodiments of the present invention have left and right wing blades that are substantially similar to one another, each of which can have the same features and elements described above.

In some embodiments of the present invention, two wear members are movably coupled to a blade, which is itself coupled to a vehicle. A pivot preferably couples the first wear member to the relative center of the blade. Another pivot preferably couples the second wear member to the relative center of the blade. At least two fasteners (and more preferably, several fasteners) can extend through respective elongated apertures in the blade respective distances from the pivots, enabling the wear members to pivot about the pivots while moving vertically by sliding of the fasteners in the elongated apertures in a manner similar to that described above.

Biasing mechanisms can be used to hold the first and second wear members in contact with the travel surface as also described above. The biasing mechanisms are preferably coupled to the blade and to the wear members relatively near the elongated apertures. In some embodiments, the biasing mechanisms are coupled to the blade and to the fasteners in a manner similar to that described above. In other embodiments, two or more biasing mechanisms can be used to hold each of the first and second wear members in contact with the travel surface as described above.

Other features and advantages of the present invention along with the organization and manner of operation thereof will become apparent to those skilled in the art upon review of the following detailed description, claims, and drawings, wherein like elements have like numerals throughout.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

In the following description, in the accompanying drawings, and in the appended claims, reference is made to a travel surface S. The term "travel surface" is intended to include any paved or unpaved surface for human or vehicular traffic or use, including for example, roads, driveways, alleys, sidewalks, taxiways, runways, tarmacs, parking lots, trails, freeways, highways, bridges, railroad crossings, and the like. The term "travel surface" therefore is intended to encompass any surface employed for travel, recreation, work, or any other use. The travel surface S is described below and shown in the attached figures as being horizontal or relatively horizontal. However, the present invention can be employed for use on travel surfaces S which are not substantially horizontal. For example, the present invention can be used to remove snow from surfaces having any incline. Also, the term "snow" as used herein and in the appended claims includes man-made and naturally occurring snow, sleet, ice, hailstones, frozen rain, slush, and the like.

Finally, terms of orientation and relative position (such as "upper", "lower", "up", "down", "left", "right", and derivations thereof) are not intended to require a particular orientation of the present invention or of any element or assembly of the present invention. Such terms are used for purposes of illustration and description only, and are not intended as limitations upon the scope of the present invention.

Figure 1:
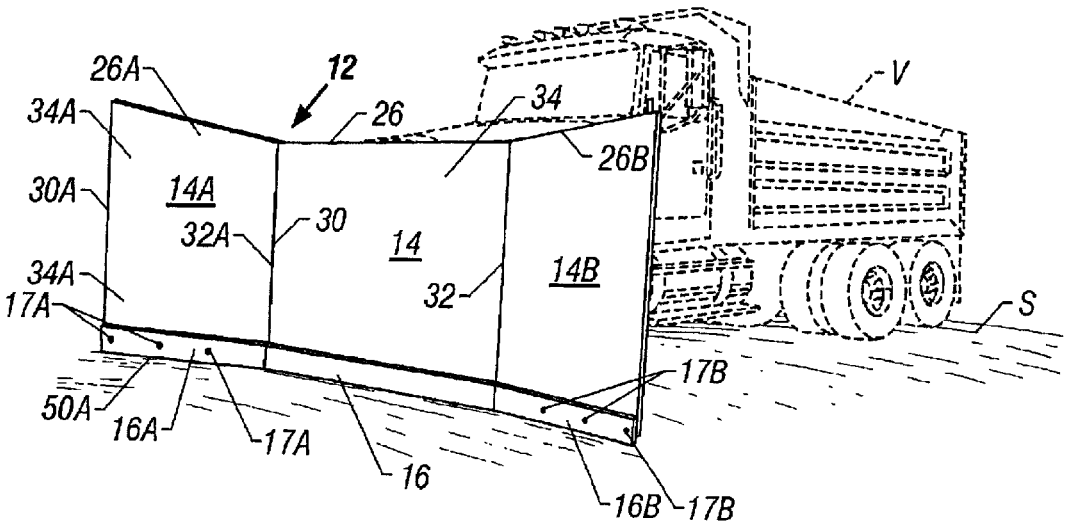
FIG. 1 is a front perspective view of a snow removal apparatus according to a preferred embodiment of the present invention, shown coupled to a vehicle.
Figure 2:
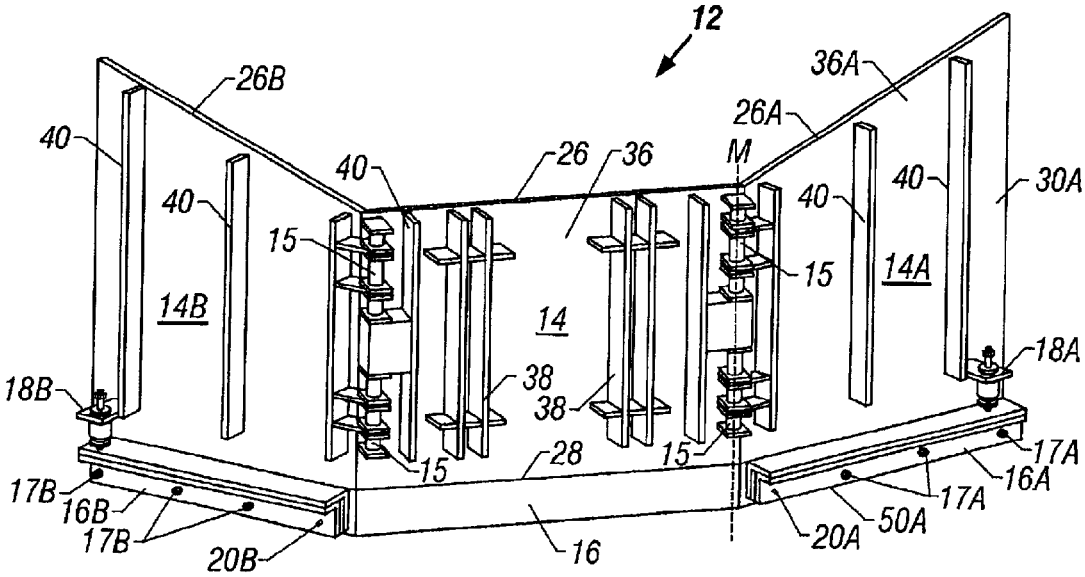
FIG. 2 is a rear perspective detail view of the snow removal apparatus illustrated in FIG. 1.

Referring first to FIG. 1, the present invention is preferably coupled to a vehicle V. The vehicle V can be any conventional vehicle V, such as a truck, tractor, garbage truck, pickup truck, van, sport utility vehicle, automobile, and the like. Also, the present invention can be coupled to or mounted on other vehicles V such as tracked vehicles, farm equipment, earth moving equipment, paving and road making equipment, construction equipment, and the like.

As shown in FIG. 1, the snow removal apparatus 12 of the present invention can be coupled to the front of the vehicle V. However, in alternative embodiments of the present invention, the snow removal apparatus 12 can be coupled to either side of a vehicle V (e.g., for operation as a wing plow). Similarly, the snow removal apparatus 12 can be positioned below a vehicle V. For example, the snow removal apparatus 12 can be coupled to the underside of a vehicle V between axles of the vehicle V. Alternatively, the snow removal apparatus 12 can be coupled to a bucket, scoop, or other attachment of a front-end loader, backhoe, bulldozer, or other earth moving, construction, or farm equipment.

The snow removal apparatus 12 preferably includes a main blade 14 coupled to a right wing blade 14A and a left wing blade 14B. In alternative embodiments of the present invention however, the snow removal apparatus 12 instead includes only the main blade 14, the main blade 14 and the right wing blade 14A, the main blade 14 and the left wing blade 14B, the right wing blade 14A alone, the left wing blade alone 14B, or the right and left wing blades 14A, 14B rigidly or moveably coupled together without the main blade 14 as described in greater detail below. Any number of main blades and wing blades can be employed in the snow removal apparatus 12 as desired, each of which are preferably coupled together in side-by-side relationship with each other or are coupled directly to the vehicle V using the same or similar elements and structure described in greater detail below.

It should be noted that the main blade 14 is not necessarily the largest or most important blade in some embodiments of the snow removal apparatus 12 (and in some cases, does not even exist). Similarly, the main blade 14 does not necessarily remove either more or less snow than the right or left wing blades 14A, 14B. The term "main" is used herein for purposes of illustration only, and is not therefore intended as a limitation upon the location, use, size, or function of the main blade 14, wing blades 14A, 14B, or of any of the other elements of the snow removal apparatus 12.

In the various embodiments of the present invention, the main blade 14 can have any number of shapes and configurations commonly employed in snow removal equipment, farming machinery, construction equipment, earth moving equipment, paving or road making equipment, and the like. For example, the main blade 14 can be relatively flat (as shown in FIG. 1), bucket-shaped, U or V-shaped (with apex away from or toward the vehicle V), shaped and/or oriented to direct snow to a central point in front of the vehicle V or to either or both sides of the vehicle V, shaped to define areas having curled or depressed cross-sections, and the like. Also, the main blade 14 can have flared wings at a right side 30, a left side 32, or both right and left sides 30, 32 of the main blade 14. An elevational cross section of any part of the main blade 14 can be flat, concave, convex, or can have any combination of these shapes.

In the illustrated preferred embodiment, the main blade 14 is relatively flat and has an upper portion 26 and a lower portion 28. As best shown in FIG. 4, the illustrated preferred embodiment of FIGS. 1–6 shows an embodiment of the present invention in which the main blade 14 presents an acute angle toward the vehicle V. However, the position and orientation of the main blade 14 relative to the vehicle V and travel surface S can be altered significantly without departing from the spirit and scope of the present invention. For example, the main blade 14 can instead be positioned perpendicular to or relatively perpendicular to the travel surface S. Alternatively, the main blade 14 can be in any other position or at any other angle relative to the travel surface S. In some embodiments, the main blade 14 is movable to present different angles relative to the travel surface S, such as by a drive frame or an elevator (described in greater detail below), manually by the operator, by hydraulic or pneumatic cylinders directly or indirectly connected to the main blade 14 and to the vehicle V, by conventional cable, gear, or chain systems, or in any other manner.

The main blade 14 has a front side 34 and a back side 36. The back side 36 of the main blade 14 preferably faces the vehicle V to which the snow removal apparatus 12 is connected. To provide rigidity and stability to the blade 14, the main blade 14 can be provided with ribs 40 extending along any part of the main blade 14 (such as along the back side 36 of the main blade 14). Although the ribs 40 can be oriented in any fashion, such as horizontally or diagonally, the ribs 40 are preferably vertically oriented. Preferably the ribs 40 are spaced along the length of the back side 36 of the main blade 14 and extend from the upper portion 26 of the main blade 14 to the lower portion 28 of the main blade 14. Also preferably, ribs 40 are provided on the right and left wing blades 14A, 14B, and can take any of the forms just described with reference to the ribs 40 of the main blade 14.

A mounting bracket or drive frame 38 is preferably rigidly coupled to the main blade 14 and to the vehicle V to support the snow removal apparatus 12. In operation, the drive frame 38 is preferably mounted to the vehicle V to allow or alternately to cause the main blade 14 to pivot from right to left with respect to the vehicle V. In this manner, the drive frame 38 and the main blade 14 can be manipulated to direct snow to either side of the vehicle V or to position the main blade 14 in any other position with respect to the vehicle V. Although the drive frame 38 can be connected at any location on the main blade 14 (such as the top or bottom of the main blade 14), the drive frame 38 is preferably connected to the back side 36 of the main blade 14. In some preferred embodiments, the drive frame 38 is also connected to either or both of the right and left wing blades 14A, 14B.

In some highly preferred embodiments of the present invention, the drive frame 38 includes an elevator (not shown) for raising and lowering the snow removal apparatus 12. Preferably, the elevator can raise the snow removal apparatus 12 off of the travel surface S and can lift the main blade 14 and/or the right and left wing blades 14A, 14B over obstacles. In some embodiments, the elevator can be used to lift snow from the travel surface S and to push or dump the snow elsewhere. Also, in some embodiments the elevator can move the snow removal apparatus 12 from side to side or can rotate the snow removal apparatus about a vertical or substantially vertical axis. For example, the elevator can preferably tilt or turn the snow removal apparatus 12 so that snow leaving the snow removal apparatus 12 is directed to one side of the vehicle V. Preferably, the elevator can then be tilted or turned so that snow leaving the snow removal apparatus 12 is directed to the other side of the vehicle V or to both sides of the vehicle V.

The elevator is preferably controlled manually in a conventional manner or by a controller (automatically and/or by user-manipulatable controls). The controller (not shown) can take any form, including a microprocessor-based controller, discrete electronics and related circuitry, and the like. Also, the controller can be located within the vehicle V, in an exterior location on the vehicle V, or can be directly or indirectly attached to the snow removal apparatus 12. Under operation of the controller, the snow removal apparatus 12 can preferably be raised and lowered.

The front side 34 of the main blade 14 is adapted to contact snow and to direct the snow away from the travel surface S traversed by the vehicle V. To prevent snow from sticking to the main blade 14, the front side 34 of the main blade 14 can be at least partially covered with a non-stick material. The non-stick material preferably also provides protection of the main blade 14 by partially or fully covering the front side 34 thereof. In this manner, the main blade 14 can be better protected from rusting, corroding, or becoming nicked or scratched. Preferably, the non-stick material is a sheet of UHMW plastic covering all or nearly all of the front side 34 of the main blade 14. In other embodiments, the non-stick material covers only one or more portions of the main blade 14, such as the lower portion 28 of the main blade 14. Any type of non-stick material can be employed, including without limitation TEFLON (DuPont Corporation), plastics, nylons, urethanes, or other synthetic material, paints or varnishes having low or non-stick properties, a sheet or layer of metal, ceramic, fiberglass, or composite materials having low or non-stick properties, and the like.

A main wear member 16 is preferably coupled to the lower portion 28 of the main blade 14. Preferably, the main wear member 16 is substantially similar in length to the main blade 14 and extends the entire length of the main blade 14 from the right side 30 of the main blade 14 to the left side 32 of the main blade 14. In other embodiments, the main wear member 16 extends only along part of the main blade 14 or is defined by multiple elements located along the main blade 14. The main wear member 16 is adapted to contact the travel surface S and snow thereon, and to travel along the travel surface S. Most preferably, only the main wear member 16 (and not the main blade 14) contacts the travel surface S during operation of the snow removal apparatus 12.

With reference to FIGS. 1–6, the right wing blade 14A of the illustrated preferred embodiment has at least one aperture 24A, a right wear member 16A, a biasing mechanism 18A, a pivot 20A rotatably coupling the right wing blade 14A and the right wear member 16A, and a fastener 17A extending through the aperture 24A and connecting the right wear member 16A to the right wing blade 14A such that the right wear member 16A is movable with respect to the right wing blade 14A. Additionally, in some embodiments and as shown in FIGS. 1–3, 5, and 6, the right wing blade 14A has a number of apertures 24A and a number of fasteners 17A extending through the apertures 24A. In order to simplify the description of the present invention, only one aperture and fastener set will be described in detail herein, it being understood that the following description can apply to wing blades having as few as one aperture 24A and corresponding fastener 17A and any greater number of apertures 24A and corresponding fasteners 17A. Also, some highly preferred embodiments of the present invention employ two or more biasing mechanisms 18A per wing blade 14A, 14B, others (including those illustrated in FIGS. 1–8) have only one biasing mechanism 18A per wing blade 14A, 14B. Accordingly, reference to only one biasing mechanism (with its corresponding elements and structure) is made herein for purposes of simplified description.

The right wing blade 14A can have any shape and configuration desired, including those described above with reference to the main blade 14 and any conventional blade shape and configuration employed for use on snow plows, earth moving equipment, farming machinery, and the like. In some preferred embodiments, the right wing blade 14A has a front side 34A, a back side 36A, an upper portion 26A, a lower portion 28A, a right side 30A, and a left side 32A. In some embodiments, the back side 36A of the right wing blade 14A is connected to the right side or to another portion of the vehicle V, to the elevator (not shown) and/or to the drive frame 38.

The front side 34A of the right wing blade 14A is adapted to contact snow and to direct the snow away from or off of the travel surface S. To prevent snow from sticking to the right wing blade 14A, the front side 34A of the right wing blade 14A is preferably at least partially covered with non-stick material as discussed above with reference to the main blade 14.

The right wing blade 14A is preferably rotatably coupled to the main blade 14, although a rigid connection of the right wing blade 14A and the main blade 14 is possible. In some preferred embodiments, hinges 15 couple the right side 30 of the main blade 14 to the left side 32A of the right wing blade 14A. Preferably, the hinges 15 enable the right wing blade 14A to rotate about an axis M at or near the interface between the right wing blade 14A and the main blade 14. The right wing blade 14A can therefore be folded inwardly and outwardly about the axis M with respect to the main blade 14. With this capability, the right wing blade 14A can preferably be folded to a position near or adjacent to the main blade 14 and/or can be folded to a position near or adjacent to the right side of the vehicle V. In this way, the snow removal apparatus 12 can be at least partially collapsed, making transportation and storage of the snow removal apparatus 12 less difficult.

Figure 3:
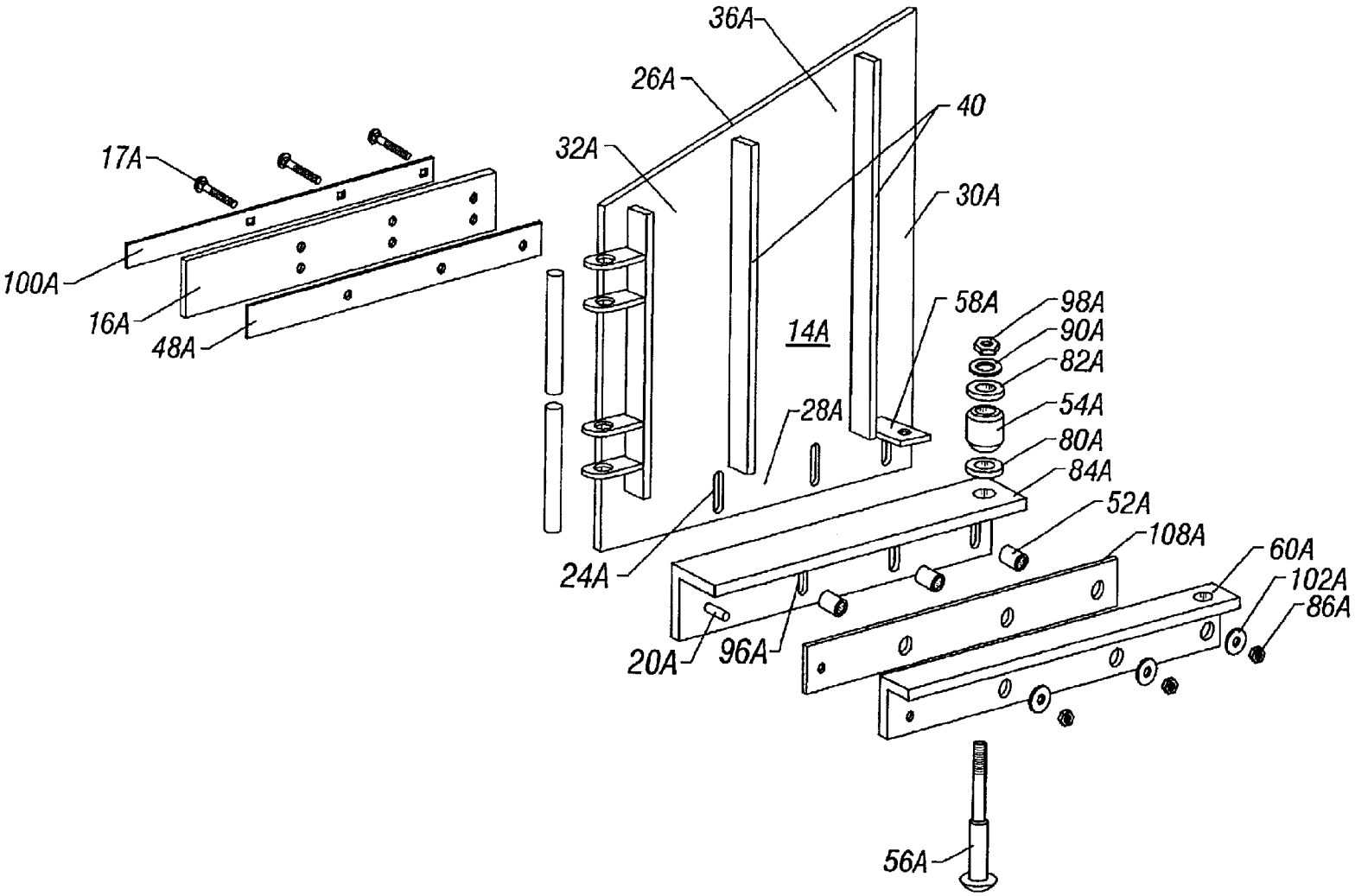
FIG. 3 is an exploded rear perspective view of part of the snow removal apparatus illustrated in FIGS. 1 and 2.
Figure 4:
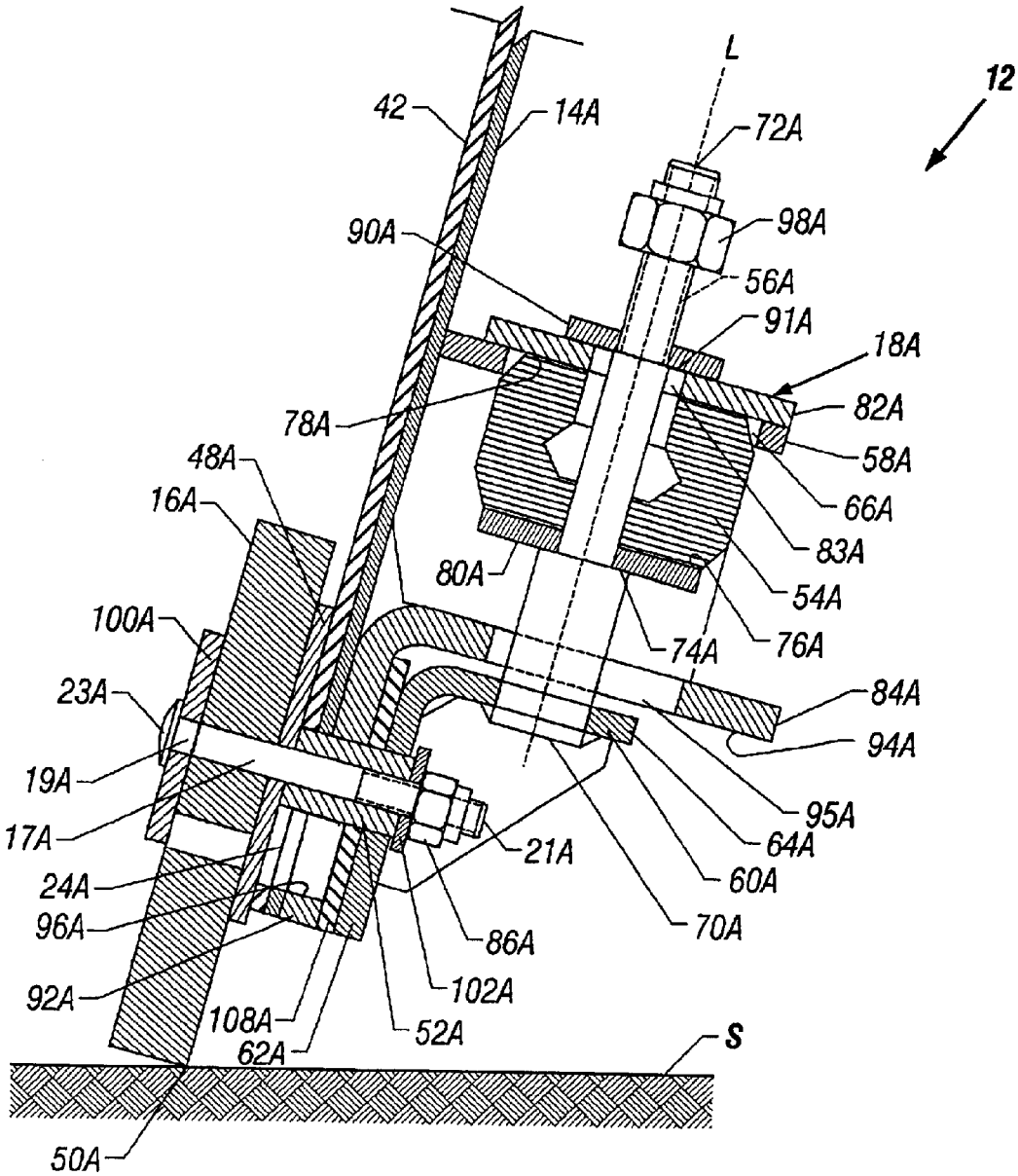
FIG. 4 is cross-sectional view of a part of the snow removal apparatus illustrated in FIGS. 1–3.
Figure 5:
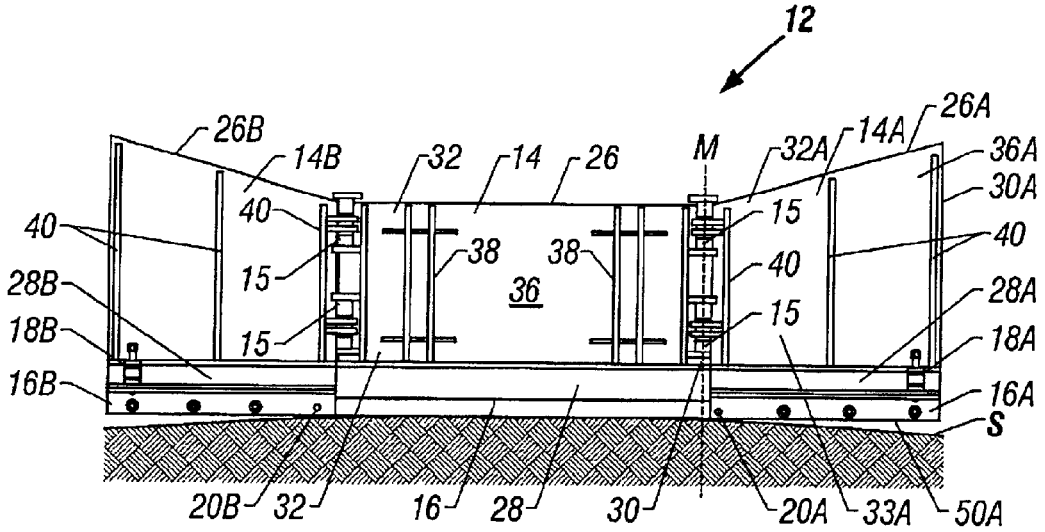
FIG. 5 is a rear elevational view of the snow removal apparatus illustrated in FIGS. 1–4, shown with the wear members in raised positions.
Figure 6:
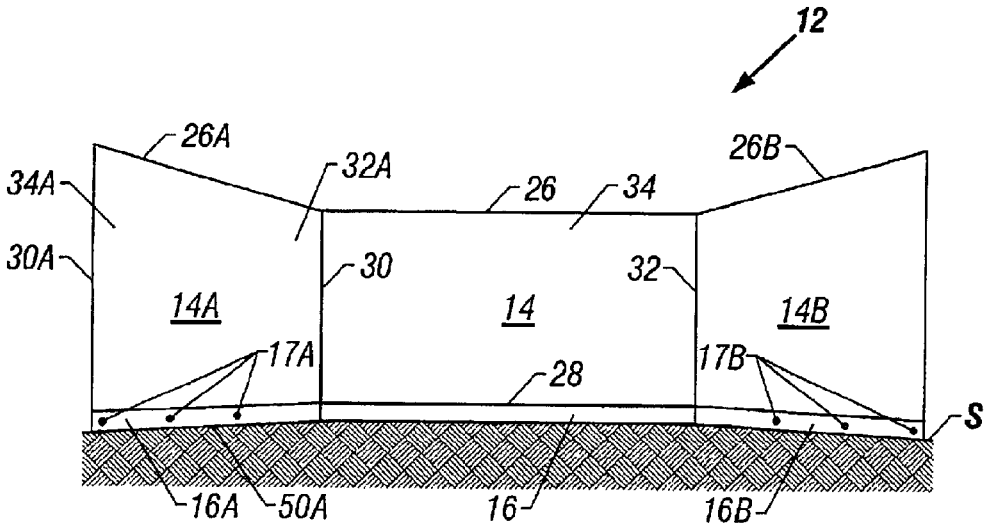
FIG. 6 is a front elevational view of the snow removal apparatus illustrated in FIGS. 1–5, shown with the wear members in lowered positions.

With additional reference to FIGS. 3 and 4, the fastener 17A is preferably directly or indirectly rigidly connected to the right wear member 16A. In addition, the aperture 24A is preferably adapted to receive the fastener 17A, which thereby connects the right wear member 16A to the right wing blade 14A. Therefore, movement of the fastener 17A in the aperture 24A results in movement of the right wear member 16A with respect to the right wing blade 14A in order to permit the right wear member 16A to follow ground contours and to overcome travel surface obstacles and features. The aperture 24A is preferably larger than that part of the fastener 17A located within the aperture 24A in order to permit the relative movement of the fastener 17A within the aperture 24A. To permit relative vertical movement, the aperture 24A is preferably larger than the fastener 17A in a vertical direction. Other types of desired relative movement are enabled by employing an aperture 24A that is larger than the fastener 17A in other directions (e.g., horizontal relative movement being enabled by an elongated horizontal aperture 24A). In some embodiments, the aperture 24A is curved, arcuately shaped, or angled so that the aperture 24A extends away from or at an angle relative to the vertical axis M. Although the aperture 24A (and therefore, a connection point between the right wear member 16A and the right wing blade 32A) is preferably located relatively near the lower portion 28A of the right wing blade 14A, other locations of the aperture 24A are possible and fall within the spirit and scope of the present invention.

The right wear member 16A is preferably adjacent the lower portion 28A of the right wing blade 14A. As shown in FIGS. 1–6, the right wear member 16A preferably has an elongated substantially rectangular shape. However, in alternative embodiments of the present invention, the right wear member 16A can have other shapes and configurations as desired, and can even be defined by multiple elements located along the lower portion 28A of the right wing blade 14A.

The right wear member 16A preferably has a contact edge 50A which preferably engages the travel surface S during operation of the snow removal apparatus 12. The right wear member 16A and the contact edge 50A are preferably made from relatively durable and wear-resistant materials. Most preferably, the right wear member 16A is made from a single piece of high carbon steel, such as machine steel, 1040 steel, 1060 steel, 1090 steel, and the like. Alternatively, the right wear member 16A can include tungsten carbide inserts. Similarly, the right wear member 16A can be made from other relatively durable and wear-resistant materials such as aluminum, iron, and other metals, ceramics, and the like. Also, the right wear member 16A can be made from other materials such as composites, plastics, and the like. In some embodiments, the right wear member 16A is made of more flexible materials such as plastic, rubber, urethane, and the like so that the right wear member 16A can more closely engage the travel surface S and can better adapt to the contours and features of the travel surface S and/or so that the right wear member 16A is less likely to damage or abrade the travel surface S.

The right wear member 16A is preferable coupled to the right wing blade 14A by the pivot 20A and by the fastener(s) 17A. In this regard, the right wear member 16A is preferably coupled to the right wing blade 14A in a manner enabling the right wear member 16A to move with respect to the right wing blade 14A. Preferably, this movement is a pivotal movement enabled by pivotably connecting the right wear member 16A to the right wing blade 14A about the pivot 20A. The pivot 20A can be located anywhere along the right wing blade 14A and the right wear member 16A, and is most preferably located on the left side 32A of the right wing blade 14A. Although the pivot 20A can extend from the right wing blade 14A, the pivot 20A can instead extend from an element connected to the right wing blade 14A (such as the bracket 84A shown in FIG. 3 and described in greater detail below). In some embodiments, the pivot 20A helps to hold the right wear member 16A and the right wing blade 14A together while allowing the right wear member 16A to rotate or pivot with respect to the right wing blade 14A.

The pivot 20A can take any conventional form, and is preferably a post extending from the right wing blade 14A and connected in any conventional manner to the right wing blade 14A or an element connected thereto. Alternatively, the pivot 20A can be a conventional fastener, such as a pin, bolt, rivet, and the like. The pivot 20A can extend from the front or rear of the right wing blade 14A for pivotal connection to the right wear member 16A either directly or indirectly. For example, the pivot 20A in the illustrated preferred embodiments extends rearwardly for pivotal connection to a fastener bracket 60A (described in greater detail below), which is connected to the right wing blade 14A via the fastener(s) 17A. In other embodiments, pivot 20A can pass through apertures in the right wing blade 14A and the right wear member 16A or can be attached to the right wing blade 14A and can extend into an aperture in the right wear member 16A (or vice versa). The pivot 20A can include one or more additional elements such as friction-reducing members (including bearings, sleeves, and the like). Also, the pivot 20A can include retaining members for holding the pivot 20A in contact with the right wing blade 14A, element attached to the right wing blade 14A, and/or the right wear member 16A. These retaining members can be heads, flanges, nuts, keys, washers, lock washers, cotter pins, and the like.

As mentioned above, the pivot 20A can be located in different positions on the right wing blade 14A and the right wear member 16A. In the illustrated preferred embodiment of FIGS. 1–6 for example, the pivot 20A is located relatively near the left side 32A of the right wing blade 14A.

In some preferred embodiments of the present invention, a backing plate 48A is positioned between at least a portion of the right wing blade 14A and the right wear member 16A. The backing plate 48A can be affixed to the right wear member 16A in any conventional manner, such as by adhesive or cohesive bonding material, welds, brazing, and the like, or can instead be retained adjacent to the right wear member 16A by the fastener(s) 17A. Alternatively, the backing plate 48A can be attached to the right wing blade 14A in any of the conventional manners just described, in which case the backing plate 48A preferably has elongated apertures similar to the elongated apertures 24A described above for receiving the fastener(s) 17A. If other fasteners are employed to connect the backing plate 48A as just described, such fasteners are preferably recessed within the backing plate 48A. As mentioned above, in some embodiments the fastener 17A hold the backing plate 48A between the right wing blade 14A and the right wear member 16A without the need for other fasteners, adhesive or cohesive bonding material or other attachment elements or material. Preferably, the backing plate 48A is a continuous element extending from the right side 30A of the right wing blade 14A to the left side 32A of the right wing blade 14A, although other single or multiple-piece elements can be employed as wear elements between the right wear member 14A and the right wing blade 14A as the right wear member 14A moves with respect to the right wing blade 14A.

In some embodiments, the backing plate 48A is made entirely or partially from steel, and therefore provides a relatively strong and stiff surface against which the spacer 52A (described in greater detail below) can press when the fastener 17A is tightened without deformation of the backing plate 48A. Such deformation could otherwise clamp together all elements through which the fastener 17A passes, thereby preventing the desired relative movement between the right wear member 16A and the right wing blade 14A (also described in greater detail below). In this regard, the backing plate 48A can be made of any other relatively strong and stiff material, including without limitation aluminum, stainless steel, iron, and other metals, composites, synthetic materials, combinations of such materials, and the like.

With reference to FIG. 4, the fastener 17A can take a number of different forms, but is preferably a conventional fastener, such as a bolt, a pin, and the like. In the illustrated preferred embodiment for example, the fastener 17A is a carriage bolt with a first end 19A and a second end 21A. The carriage bolt 17A preferably has a square shank mating with square apertures in the backing plate 48A, right wing blade 14A, and/or retaining bar 100A (described below). Although the fastener 17A can have any bolt head shape desired, the first end of the fastener 17A preferably has a round head 23A which holds the fastener 17A in place on the right wear member 16A As best shown in FIGS. 3 and 4, the fastener 17A preferably extends through an aperture in the right wear member 16A and through the aperture 24A in the right wing blade 14A. In some embodiments, the fastener 17A includes a square or rectangular section positioned between the first and second ends 19A, 21A to prevent the fastener 17A from rotating with respect to the aperture 24A. In a number of embodiments, such as some embodiments employing one or more biasing mechanisms 18A for biasing the right wear member 16A toward the travel surface S, the fastener 17A extends through the right wear member 16A, the aperture 24A, and one or more brackets 84A, 60A (described below). The fastener 17A can also extend through the backing plate 48A (where employed). In other embodiments of the present invention, the fastener 17A does not pass through an aperture in the right wear member 16A or the brackets 84A, 60A, and is instead attached to either of these elements in any conventional manner. For example, the fastener 17A can be an integral part of the right wear member 16A or either bracket 84A, 60A, can be welded or brazed to these elements, can be secured thereto using adhesive or cohesive bonding material, or in any other manner desired.

Preferably, the fastener 17A slidably couples the right wear member 16A to the right wing blade 14A so that the right wear member 16A can rotate about an axis defined by the pivot 20A while the fastener 17A travels within the aperture 24A.

The fastener 17A and the aperture 24A can be located in a number of different positions on the right wing blade 14A and right wear member 16A. As shown in the preferred embodiment illustrated in FIGS. 1–6, the fastener 17A and the aperture 24A can be located relatively near the right (outer) side 30A of the right wing blade 14A and right wear member 16A. Alternatively, the fastener 17A and the aperture 24A can be located relatively nearer to the left (inner) side 32A of the right wing blade 14A and right wear member 16A, or in any other location along these elements. In some preferred embodiments of the present invention and in the illustrated FIGS. 1–3 and 5–6, the right wing blade 14A has a plurality of apertures 24A adapted to receive a plurality of fasteners 17A. Preferably, the apertures 24A are spaced along the lower portion 28A of the right wing blade 14A. In this manner, the fasteners 17A can attach the right wear member 16A and the right wing blade 14A together at a number of different locations.

If desired, and depending upon the type of fastener 17A employed to connect the right wing blade 14A to the right wear member 16A, additional fastener hardware can be employed to secure and improve this connection. For example, the fastener 17A is preferably held in place on the right wing blade 14A and the right wear member 16A by a retaining bar 100A and by a retaining nut 86A and a washer 102A for each fastener 17A. The retaining bar 100A is preferably positioned between the head 23A of the fastener 17A and the right wear member 16A and preferably extends along at least part of the right wear member 16A. Most preferably, the retaining bar 100A (if used) extends along the entire length of the right wear member 16A, and can have multiple apertures through which multiple fasteners 17A are inserted. In some embodiments, the retaining bar 100A has square or rectangular holes to prevent a square-necked fastener 17A from rotating with respect to the retaining bar 100A. The retaining nut 86A is preferably threaded onto the second end 21A of the fastener 17A. The washer 102A is preferably located at the second end 21A of the fastener 17A adjacent the retaining nut 86A. If desired, the retaining nut 86A can be a conventional lock nut, and/or the fastener 17A can be provided with thread locking compound to further secure the fastener 17A. In some highly preferred embodiments, the retaining nut 86A is a lock nut having a nylon insert. Although the orientation of the fastener as shown in the figures is preferred, in alternative embodiments the orientation of the fastener 17A is reversed (along with the head 23A of the fastener 17A and the retaining nut 86A).

In other highly preferred embodiments, other elements can be employed to perform the same or similar functions as the fastener 17A and can connect the right wear member 16A to the right wing blade 14A. For example, a pin, post, shaft, finger, rivet, or any other element capable of extending through the aperture 24A can be employed.

In order to permit relative movement of the right wing blade 14A and the right wear member 16A, a spacer element is preferably included to prevent compression of these two elements against one another. In the illustrated preferred embodiment of FIG. 4 for example, a spacer 52A extends between the right wing blade 14A and the right wear member 16A. Although the spacer 52A can be in a number of locations while still performing the function of preventing the above-noted compression, the spacer 52A in the illustrated preferred embodiment surrounds at least a portion of the fastener 17A. Preferably, the spacer 52A is located between the first and second ends 19A, 21A of the fastener 17A for travel in the aperture 24A. Travel in the aperture 24A can be limited in a number of manners. For example, in the illustrated preferred embodiment of FIG. 4, the spacer 52A can contact and be stopped by the right wing blade 14A and/or the bracket 84A. The spacer 52A can prevent compression of the right wing blade 14A and the right wear member 16A by abutting the right wing blade 14A or the backing plate 48A and by abutting the washer 102A (or part thereof), the fastener bracket 60A, or other elements sandwiching the right wing blade 14A. In embodiments with a plurality of fasteners 17A extending through a plurality of apertures 24A, each fastener 17A preferably includes a spacer 52A and a retaining nut 86A. Additionally, the spacers 52A preferably are similarly sized so that the fasteners 17A and the retaining nuts 86A can be tightened without pinching the right wear member 16A, the bar 100A, or the right wing blade 14A.

The spacer 52A preferably ensures that the right wear member 16A is able to move with respect to the right wing blade 14A about an axis defined by the pivot 20A. The spacer 52A can also perform the function of preventing or limiting the elements of the snow removal apparatus 12 (e.g., the brackets 60A, 84A, the right wing blade 14A, and the like) from contacting the fastener 17A.

Some preferred embodiments of the present invention employ one or more biasing mechanisms 18A for biasing the wear member 16A toward the travel surface S for improved performance of the snow removal apparatus 12. The biasing mechanism(s) 18A can take a number of different forms, one of which is illustrated in the embodiment of FIGS. 1–6. In this and in other preferred embodiments, the biasing mechanism(s) 18A are associated with and connected to respective fasteners 17A. In this regard, each fastener 17A can be provided with a respective biasing mechanism 18A. However, in other embodiments, not all of the fasteners 17A have biasing mechanisms 18A. For example, the snow removal apparatus 12 illustrated in FIGS. 1–6 has only one biasing mechanism 18A for each wing blade 14A, 14B. With continued reference to this embodiment, the biasing mechanism 18A preferably includes a spring 54A, a shaft 56A, a biasing mechanism bracket 58A, and a fastener bracket 60A to which the fastener 17A is attached. A longitudinal axis L defined by the shaft 56A is preferably relatively parallel to the right wing blade 14A, although this axis L can be at other angles with respect to the right wing blade 14A in other embodiments.

As shown in FIG. 4, in some embodiments of the present invention the spring 54A is a rubber spring positioned on the shaft 56A. In other embodiments of the present invention, other biasing members and elements can also or alternatively be used. For example, the spring 54A can alternatively be a compression spring, a torsion spring, an air spring, a hydraulic or pneumatic cylinder, a leaf spring, an extension spring, elastic elements, compressible bladders, and the like. As used herein and in the appended claims, the term "spring" is intended to encompass all such elements and devices.

Referring again to the embodiment illustrated in FIGS. 1–6, the biasing mechanism 18A (including the spring 54A) is shown positioned relatively near the right side 30A of the right wing blade 14A, while the right wear member 16A and a pivot 20A is positioned relatively near the left side 32A of the of the right wing blade 14A and the right wear member 16A. In this embodiment, the spring 54A is a rubber spring or other element or mechanism (see above) capable of exerting spring force in reaction to compression. The spring 54A is operable to apply a downward force to the right wear member 16A and to maintain the right wear member 16A in engagement with the travel surface S. In alternative embodiments of the present invention, the pivot 20A and the biasing mechanism 18A can be positioned in different locations along the right wing blade 14A and the right wear member 16A. In some such embodiments, for example, the biasing mechanism 18A can include an extension spring 54A, such as an extension spring 54A positioned relatively near the left side 32A of the right wing blade 14A in FIGS. 1–6, with the pivot 20A positioned relatively near the right side 30A of the right wing blade 14A. In still other embodiments, the biasing mechanism 18A and the pivot 20A can be oriented and positioned in any number of different locations along the right wing blade 14A and the right wear member 16A.

In the illustrated preferred embodiment of FIGS. 1–6, the right wear member 16A pivots about an axis defined by the pivot 20A to permit relatively vertical movement of the right wear member 16A with respect to the right wing blade 14A. However, in other embodiments, the right wear member 16A is not necessarily connected to pivot about an axis defined by the pivot 20A as shown, or is connected to pivot about any other location along the right wing blade 14A. In such alternative embodiments, the right wear member 16A can be connected to translate or to move in any combination of translation and rotation permitted by the fastener(s) 17A in their respective apertures 24A.

The biasing mechanism bracket 58A is preferably coupled to the back side 36A of the right wing blade 14A and preferably extends away from the right wing blade 14A (for example, in a direction substantially perpendicular to the longitudinal axis L). Alternatively, the biasing mechanism bracket 58A can be coupled to one or more of the ribs 40 (if employed) located on the right wing blade 14A, or even to the drive frame 38.

The biasing mechanism bracket 58A preferably provides support for the spring 54A or other biasing element or device to exert a downward force upon the right wear member 16A. Accordingly, the shape and location of the biasing mechanism bracket 58A can vary significantly depending at least in part upon the type of biasing element or device employed. For example, in the illustrated preferred embodiment where a shaft 56A and a rubber spring 54A are used to bias the right wear member 16A toward the travel surface S, the biasing mechanism bracket 58A preferably receives the shaft 56A through an opening 66A. The longitudinal axis L preferably extends through the opening 66A. The opening 66A can have any shape capable of receiving the shaft 56A, and in some preferred embodiments is round. Preferably, the opening 66A is sized to be larger than the shaft 56A. Most preferably, the opening 66A is similar in size and shape to the shaft 56A. It will be appreciated by one having ordinary skill in the art that the biasing mechanism bracket 58A can take a number of other shapes suitable for different biasing elements or devices, each one of which falls within the spirit and scope of the present invention.

The fastener bracket 60A functions to connect the right wear member 16A (and more specifically, the fastener 17A connected thereto) to the other elements of the biasing mechanism 18A. In this regard, the fastener bracket 60A can have any shape suitable for performing this function. By way of example only, the fastener bracket 60A in the illustrated preferred embodiment has an L-shape, including a first leg 62A and a second leg 64A. The first leg 62A is preferably coupled to the fastener 17A for motion with the fastener 17A along the aperture 24A. In some alternative embodiments, the first leg 62A is coupled in other manners (e.g., directly) to the right wear member 16A. Although the fastener 17A is preferably received within an aperture in the first leg 62A of the fastener bracket 60A, other manners of connecting these elements together are possible, such as by an integral fastener 17A and fastener bracket 60A, by welding or brazing, by adhesive or cohesive bonding material, by a threaded, snap-fit, or press-fit connection, or by one or more conventional fasteners.

In some preferred embodiments of the present invention, the fastener bracket 60A is substantially parallel to the right wing blade 14A and extends along all or a substantial length of the lower portion 28A of the right wing blade 14A. In other embodiments, a separate fastener bracket 60A is employed for each biasing mechanism 18A, so the fastener bracket(s) 60A can be considerably shorter. Preferably, a plurality of fasteners 17A extend through the first leg(s) 62A of the fastener brackets 60A, each one of the fasteners 17A preferably extending through a respective aperture 24A. The second leg 64A of the fastener bracket 60A can be at an angle relative to the first leg 62A so that the longitudinal axis L extends through the second leg 64A of the fastener bracket 60A.

As discussed above, the shaft 56A of the biasing mechanism 18A is preferably coaxial with the longitudinal axis L. The shaft 56A has a first end 70A and a second end 72A. The first end of the shaft 70A is preferably rigidly coupled in any conventional manner to the second leg 64A of the fastener bracket 60A, including any of the manners described above regarding the connection of the fastener bracket 60A to the fastener 17A. Preferably, the first end of the shaft 70A is welded to the second leg 64A of the fastener bracket 60A. The second end of the shaft 72A preferably extends through the opening 66A in the biasing mechanism bracket 58A. The shaft 56A can be a bolt or any other conventional fastener connected to the biasing mechanism bracket 58A and to the fastener bracket 60A as described above.

Between the first and the second ends 70A, 72A, the shaft 56A preferably has a shoulder 74A (as best seen in FIG. 4) for holding the spring 54A in position on the shaft 56A. The shoulder 74A can be machined into the shaft 56A, can be formed upon the shaft 56A in any other manner, or the shoulder 74A can be a washer or another similar member coupled to the shaft 56A in any conventional manner, such as by welding, snap or press fitting, interference fitting, screwing with mating threads on the shaft 56A, and the like. To provide additional support for the spring 54A, a retaining plate or washer 80A can be positioned on the shaft 56A and can be held in place by the shoulder 74A. The retaining plate or washer 80A can take any of the forms and can be connected in any of the manners just described with respect to the shoulder 74A. The shoulder 74A and the retaining plate or washer 80A function to hold the spring 54A in position in the biasing mechanism 18A. It will be appreciated by one having ordinary skill in the art that a number of other elements and structure can be employed to perform this same function, including without limitation one or more pins, fingers, bosses, or other protrusions extending from the shaft 56A.

As mentioned above, the spring 54A is preferably a rubber spring having a first end 76A and a second end 78A. Rubber springs and other springs made of many other types of elastomeric material are preferred due to their ability to withstand extreme temperatures (e.g., −60° F. in some cases), although other types of springs can be employed as desired. For example, the spring 54A can be a conventional compression spring. As other examples, leaf springs, torsion springs, belville washers, and the like. The spring 54A is preferably mounted on the shaft 56A along the longitudinal axis L. Preferably, the spring 54A is retained between the shoulder 74A and/or the retaining plate or washer 80A and the biasing mechanism bracket 58A.

In some embodiments, the biasing mechanism bracket 58A can be shaped to provide support for the spring 54A when compressed. However, any number of other or additional elements can be employed to perform this function. For example, and as best shown in FIG. 4, a second retaining plate 82A or washer can be coupled to the bracket 58A, covering at least a portion of the opening 66A. Preferably, the second retaining plate 82A or washer holds the spring 54A in place on the shaft 56A and prevents the spring 54A from slipping through the opening 66A. The second retaining plate or washer 82A (or other element performing the same function) preferably has an opening, recess, or opening 83A which is larger than the shaft 56A so that the spring 54A cannot pass through the openings 66A, 83A.

A retaining nut 98A is preferably threaded onto the second end of the shaft 72A. The retaining nut 98A can be of any conventional form such as those described above with reference to the nut 86A on the fastener 17A, but is preferably a locking nut. In some highly preferred embodiments, the locking nut 86A has a nylon insert. Alternatively or in addition, locking compound can be employed to help retain the nut 98A in place on the shaft 72A.

In some preferred embodiments of the present invention, it is desirable to limit the motion of the biasing mechanism 18A (and therefore the right wear member 16A). For example, in many cases it is undesirable to overcompress or overextend the spring 54A. As another example, it may be desirable to limit the amount of downward or upward travel of the right wear member 16A (under force from the spring 54A or otherwise), such as to limit or control wear of the right wear member 16A. Similarly, it can be desirable to adjust the amount of downward or upward force that is applied to the right wear member 16A by the biasing mechanism 18A. In such cases, the retaining nut 98A can preferably be tightened or loosened to move the right wear member 16A closer to and further from the travel surfaces S. In this manner, the biasing member 18A can be adjusted to accommodate travel surfaces S having any particular shape or slope. Although not required to practice the present invention, limiting the movement of biasing mechanism 18A is therefore desirable in many cases. The biasing mechanism 18A can be limited in compression and/or extension in a number of different manners.

By way of example only, the biasing mechanism 18A in the illustrated preferred embodiment is limited in compression by the bracket 84A and is limited in extension by a limit plate 90A on the shaft 56A as best shown in FIG. 4. The limit plate or washer 90A is preferably threaded on the shaft 56A, and in some embodiments can therefore be adjusted to different positions on the shaft 56A to pre-compress the spring 54A different amounts for different biasing mechanism 18A performance. In some embodiments, the retaining nut 98A on the shaft 56A can be tightened to retain the limit plate 90A in a desired position on the shaft 56A, such as to set a desired angle of the right wear member 16 suitable for a particular surface to be plowed.

The limit plate 90A can have any shape and size capable of performing the function of limiting shaft travel as described above. In this regard, the limit plate 90A can be a nut threaded upon the shaft 56A, can be a collar or plate welded or brazed on the shaft 56A, can be a lip or other radial extension of the shaft 56A, can be one or more pins, bosses, or other protrusions extending from the shaft 56A, and the like. Preferably however, the limit plate 90A is adjustable to different positions on the shaft 56A.

As mentioned above, movement of the biasing mechanism 18A is preferably also limited by the bracket 84A. Preferably, the bracket 84A is connected to the blade 14A, and is shaped to extend to a position relative to the shaft 56A in which the bracket 84A can limit shaft movement as described above. To this end, the bracket 84A can have any shape desired, and in the illustrated preferred embodiment has an L-shape with a first leg 92A coupled to the lower portion 28A of the blade 14A and a second leg 94A extending laterally away from the right wing blade 14A. In some embodiments, the bracket 84A is positioned so that the fastener 17A passes therethrough. For example, the bracket 84A illustrated in FIG. 4 has an aperture 96A extending through the first leg 92A. Like the aperture 24A in the blade 14A, the aperture 96A in the first leg 92A is preferably sufficiently large to enable movement of the fastener 17A in a direction desired. For vertical wear member 16A movement as described above, the aperture 96A in the illustrated preferred embodiment is elongated in a vertical direction. Preferably, the aperture 96A in the bracket 84A is shaped to be similar to the aperture 24A.

The second leg 94A of the bracket 84A in the illustrated preferred embodiment of FIG. 4 preferably has an opening 95A. The first end 70A of the shaft 56A preferably extends through the opening 95A in the second leg 94A of the bracket 84A. The opening 95A is sufficiently large to permit the shaft 56A to move relatively freely through the bracket 84A.

The bracket 84A can be connected to the right blade 14A in any desired manner, such as by welds, brazing, by one or more bolts, rivets, pins, or other fasteners, by adhesive or cohesive bonding material, and the like. By virtue of its position with respect to the shaft 56A and the fastener bracket 60A, the biasing mechanism 18A is preferably limited in its movement by interference of the bracket 84A and the fastener bracket 60A. More specifically, compression (e.g., overcompression) of the spring 54A can preferably be prevented by the fastener bracket 60A abutting the bracket 84A. This manner of limiting biasing mechanism 18A movement can be employed in addition to or instead of limiting such movement by interference of the fastener 17A in the aperture 24A.

It will be appreciated by one having ordinary skill in the art that the spring 54A can be retained in position to provide a downward force upon the right wear member 16A in a number of different manners. For example, a compression spring can be retained between a bracket, plate, ledge, arm, or other element attached to the right wear member 16A and a bracket, plate, ledge, arm, or other element attached to the right wing blade 14A without the use of a shaft 56A as described above and illustrated in the figures. In this regard, either bracket, plate, ledge, arm or other element can have any shape capable of performing this function. Each alternative manner of retaining the spring 54A in position to provide its biasing force falls within the spirit and scope of the present invention.

With continued reference to FIG. 4, movement of the fastener bracket 60A with respect to the right blade 14A can be enhanced by the use of a backing plate 108A located between the brackets 84A, 60A. The backing plate 108A preferably provides a low-friction interface for the fastener bracket 60A to move with respect to the right blade 14A. In the illustrated preferred embodiment, the backing plate 108A is located between the first leg 92A of the bracket 84A and the first leg 62A of the fastener bracket 60A, although in other embodiments, the backing plate 108 can be located in different positions.

The backing plate 108A preferably has a relatively smooth friction-reducing outer surface. As mentioned above, the first leg 62A of the fastener bracket 60A preferably moves with the fastener 17A along the aperture 24A and the first leg 92A of the bracket 84A is preferably attached to the back side 36A of the right wing blade 14A. The backing plate 108A preferably minimizes the friction between the first leg 92A of the bracket 84A and the first leg 62A of the fastener bracket 60A so that the fastener bracket 60A can move relatively freely with the fastener 17A. The backing plate 108A can be secured to the bracket 84A (in which case the backing plate 108 can have an elongated aperture in order to permit movement of the fastener 17A therein) or to the fastener bracket 60A in any of the manners described above with regard to the backing plate 48A located between the right wear member 16A and the right wing blade 14A, and in some embodiments is not secured to either element but is instead retained therebetween.

Preferably, the above description regarding the right wing blade 14A is equally applicable to the left wing blade 14B. More specifically, the above description regarding the right wing blade 14A, the right wear member 16A, the biasing mechanism 18A, and the various elements, components, and structure associated therewith preferably applies equally to the left wing blade 14B.

In operation, the vehicle V preferably moves the snow removal apparatus 12 across a travel surface S, which is at least partially covered with snow. Preferably, the operator lowers the snow removal apparatus 12 with the elevator so that at least a portion of the right and the left wear members 16A, 16B contact the travel surface S. The vehicle V then moves along the travel surface S, preferably pushing or throwing snow off of the travel surface S. As described in greater detail above, the snow can be thrown or pushed to either or to both sides of the vehicle V depending at least in part upon the orientation and arrangement of the blade 14.

As the vehicle V moves across the travel surface S, the snow removal apparatus 12 adjusts to the changing contours of the travel surface S by rotating the right and/or left wear members 16A, 16B about axes defined by the pivots 20A, 20B, respectively and the fasteners 17A, 17B travel along the apertures 24A, 24B, respectively. Preferably, when the snow removal apparatus 12 traverses an area of the travel surface S which has a crown or which is otherwise not completely flat, the snow removal apparatus 12 adjusts so that the right and/or the left wear members 16A, 16B remain in contact with the travel surface S. In other embodiments of the present invention, a wear member 16 and biasing mechanism 18 according to the present invention can be employed on a main blade with or without wing blades and on some or all wing blades (whether used with a main blade or not). Because the pivot(s) and the biasing mechanism 18A can be located anywhere along the main and/or wing blades, the wear members 16 can pivot in any manner desired, such as about the outer edges of the wing blades, a center position of the wing or main blades, and the like. If desired, multiple wear members 16 can even be employed on the same wing or main blade.

With reference again to FIGS. 1-6 (applicable also to the left wing blade 14B), the biasing mechanism 18A preferably applies a downward force to the right wear member 16A, pressing the right wear member 16A against the travel surface S. In this manner, a sloped travel surface (across the length of the apparatus 12) can be cleared more effectively because the wear members 16, 16A, 16B are capable of contouring to the surface S. Also, the apparatus 12 can at least partially adapt to changes in contour of the travel surface S, such as rises or falls, bumps, cracks, rumble strips, pot holes, and other obstructions located along the travel surface S or changes in the elevation of the travel surface S. A sloped travel surface S or changes in contour of the travel surface S cause the right wear member 16A to rotate about an axis defined by the pivot 20A and cause the fastener 17A to slide upwardly or downwardly in the aperture 24A.

For example, in the case where the right wear member 16A is moved upwardly, the right wear member 16A and/or the fastener 17A preferably push the fastener bracket 60A upward along a path substantially parallel to the longitudinal axis L. The fastener bracket 60A preferably pushes the shaft 56A upwardly along the longitudinal axis L, thereby compressing the spring 54A between the retaining plate 80A and the biasing mechanism bracket 58A. Once the right wear member 16A passes the obstruction or once the contours of the travel surface S change to permit the right wear member 16A to fall, the compressed spring 54A preferably provides a downward force along the longitudinal axis L, pressing the shaft 56A, the biasing mechanism bracket 58A, the fastener 17A, and at least part of the right wear member 16A downward toward the travel surface S. In a similar manner, a second biasing mechanism 18B (not shown) can apply a downward force to the left wear member 16B for operation in a manner similar to that just described.

Figure 7:
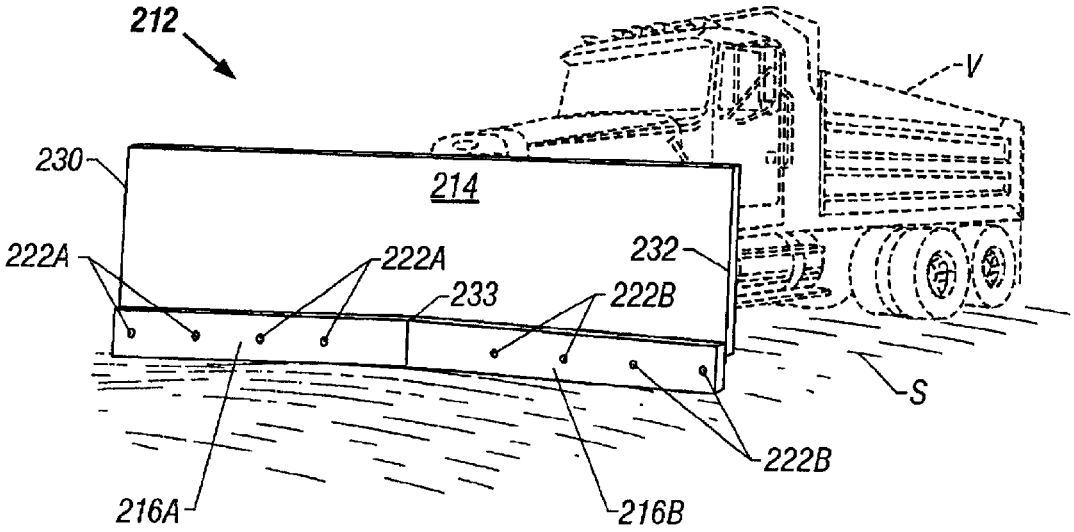
FIG. 7 is a front perspective view of a snow removal apparatus according to a second preferred embodiment of the present invention, shown connected to a vehicle.
Figure 8:
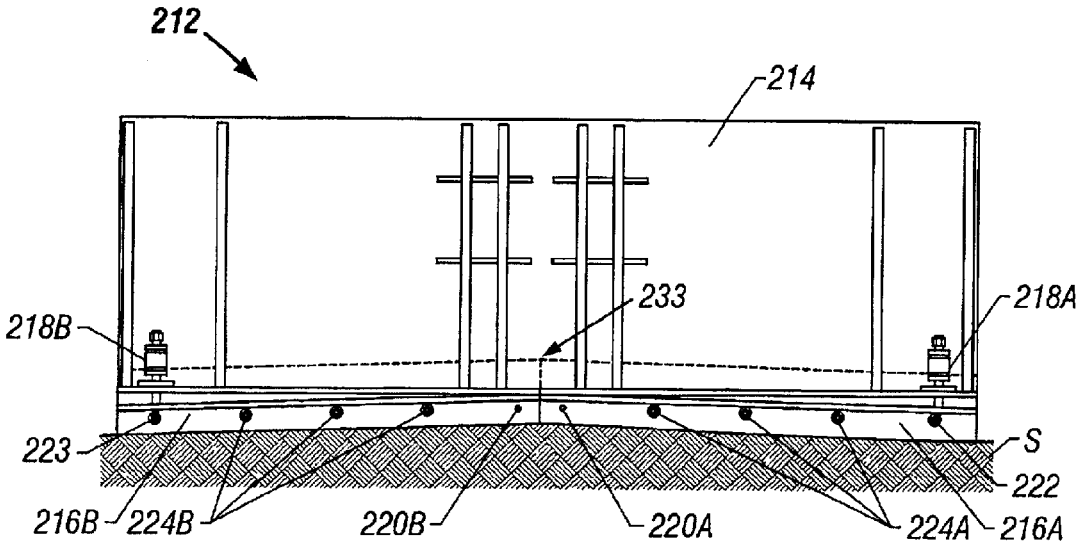
FIG. 8 is a rear elevational view of the snow removal apparatus illustrated in FIG. 7.

FIGS. 7 and 8 show a second preferred embodiment of the present invention. Because the second preferred embodiment of the present invention is substantially similar to the first preferred embodiment, only differences between the first and the second preferred embodiments will be discussed hereafter. In the second preferred embodiment, the snow removal apparatus 212 includes a blade 214, apertures 224A, 224B, a right wear member 216A, a left wear member 216B, a pivot 220A rotatably coupling the blade 214 and the right wear member 216A, a pivot 220B rotatably coupling the blade 214 and the left wear member 216B, a biasing mechanism 218A, a second biasing mechanism 218B, and fasteners 222, 223 extending through the apertures 224A, 224B.

The blade 214 preferably has a right side 230, a left side 232 and a central point 233. Preferably, the aperture 224A is located relatively near the right side 230 of the blade 214 and the second elongated aperture 224B is preferably located relatively near the left side 232 of the blade 214.

The right wear member 216A is preferably rotatably coupled to the blade 214 by the pivot 220A, located relatively near the central point 233 on the blade 214. The fastener 222 preferably couples the right wear member 216A to the blade 214 and to the aperture 224A relatively near the right side 230 of the blade 214.

The left wear member 216B is preferably rotatably coupled to the blade 214 by the pivot 220B, located relatively near the central point on the blade 233. The fastener 223B preferably couples the left wear member 216B to the blade 214 and to the elongated aperture 224B relatively near the left side 232 of the blade 214.

The biasing mechanism 218A is preferably coupled to the blade 214 relatively near the right side 230 of the blade 214 and to the right wear member 216A. The biasing mechanism 218B is preferably coupled to the blade 214 relatively near the left side 232 of the blade 214 and to the left wear member 216B.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, the present invention is described herein as being used to remove snow. However, one having ordinary skill in the art would appreciate that the present invention could also be used to, for example, remove or distribute soil, gravel, asphalt, or the like from or over a given area. Additionally, the present invention could have application in construction, paving and road grading, agriculture, earth moving, and other similar industries.

As another example, the aperture 24A described above and illustrated in the figures is preferably defined in the right wing blade 14A. In other embodiments, the aperture 24A can instead be defined in the right wear member 16A to enable the right wear member 16A to move with respect to a fastener 17A extending in the aperture 24A. In still other embodiments, the aperture 24A can take a number of other forms, a number of which are defined by an edge of the right wing blade 14A. Such apertures include without limitation notches, recesses, or other edge shapes of the right wing blade 14A. Any shape of the right wing blade 14A enabling relative movement of the right wear member 16A and fastener 17A with respect to the right wing blade 14A can be employed as desired.

As such, the functions of the various elements and assemblies of the present invention can be changed to a significant degree without departing from the spirit and scope of the present invention.

What is claimed is:

1. A snow removal apparatus comprising:

a blade having a lower edge;

a wear member moveably coupled to the blade about a pivot for upward and downward movement with respect to the blade to follow ground contours during operation, the wear member extending along at least a portion of the lower edge of the blade and pivotable about an axis extending through the blade and the wear member;

a plurality of apertures defined along the blade;

a plurality of fasteners extending through and movable within the plurality of apertures and coupling the wear member to the blade; and a spacer at least partially surrounding at least one of the plurality of fasteners, the spacer adapted to travel in at least one of the apertures.

2. The snow removal apparatus of claim 1, wherein the wear member is resiliently biased away from the blade.

3. The snow removal apparatus of claim 2, further comprising a spring positioned to resiliently bias the wear member away from the blade.

4. The snow removal apparatus of claim 1, wherein:

the blade has a first side and a second side; and the wear member is pivotably coupled to the first side of the blade;

the snow removal apparatus further comprising an aperture defined in the second side of the blade.

5. The snow removal apparatus of claim 1, further comprising a second blade rotatably coupled to the first blade.

6. The snow removal apparatus of claim 5, further comprising a third blade, the third blade rotatably coupled to the first blade opposite the second blade.

7. The snow removal apparatus of claim 1, wherein the wear member is biased downward by a spring coupled to the wear member and to the blade.

8. The snow removal apparatus of claim 7, further comprising a shaft coupled to the wear member and to the spring, the shaft being movable with respect to the blade to alter compression of the spring.

9. A snow removal apparatus comprising:

a blade having an edge;

a wear member extending along at least a portion of the edge of the blade and having a longitudinal axis extending between a first end and a second end of the wear member, the first end of the wear member pivotably coupled to the blade about a pivot having a second axis substantially normal to the longitudinal axis;

a spring coupled to the blade and to the wear member a first distance from the pivot point, the spring positioned to bias at least a portion of the wear member away from the blade;

an aperture defined in the blade and located a second distance from the pivot point;

a fastener coupled to the blade and to time second end of the wear member, the fastener extending through the aperture in the blade and movable within the aperture to move the wear member with respect to the blade; and a spacer at least partially surrounding the fastener and movable with the fastener in the aperture.

10. The snow removal apparatus of claim 9, further comprising:

a plurality of apertures defined in the blade; and a plurality of fasteners coupled to the blade and to the wear member, the plurality of fastener extending through the apertures and movable in the apertures to move the wear member with respect to the blade.

11. The snow removal apparatus of claim 9, further comprising a second blade rotatably coupled to the first blade.

12. The snow removal apparatus of claim 11, further comprising a third blade rotatably coupled to the first blade opposite the second blade.

* * * * *